United States Patent [19]

Weidner et al.

[11] 3,958,796

[45] May 25, 1976

[54] QUENCH-HARDENING OF PIPES

[75] Inventors: Helmut Weidner, Dortmund-Korne; Helmut Landgraf, Rumeln-Kaldenhausen, both of Germany

[73] Assignee: Mannesmannrohren-Werke AG, Dusseldorf, Germany

[22] Filed: Sept. 26, 1974

[21] Appl. No.: 509,569

[30] Foreign Application Priority Data

Oct. 2, 1973 Germany ..... 2349913

[52] U.S. Cl. ..... 266/123; 266/134

[51] Int. Cl.[2] ..... C21D 1/62

[58] Field of Search ..... 266/4 S, 6 S, 4 R, 6 R; 148/143; 134/199

[56] References Cited

UNITED STATES PATENTS

| | | | |
|---|---|---|---|
| 3,546,911 | 12/1970 | Lenz | 266/6 S |
| 3,804,390 | 4/1974 | Jennings | 266/4 S |

*Primary Examiner*—Roy Lake
*Assistant Examiner*—Mark S. Bicks
*Attorney, Agent, or Firm*—Ralf H. Siegemund

[57] ABSTRACT

Large diameter pipes are moved past a preheater, an induction heater, prequench nozzles, a sizing mill and post quench nozzles. An inside quenching head is mounted on a support tube, held against the inside wall of a pipe by rollers right at the sizing stand. The sizing rollers maintain or restore circularity of the pipe concurrently with quenching.

7 Claims, 3 Drawing Figures

10
19
20
18
15
16
6

QUENCH-HARDENING OF PIPES

BACKGROUND OF THE INVENTION

The present invention relates to quench-hardening of pipes of large diameter and when in horizontal disposition; and more particularly the invention relates to improvements in quench-hardening equipment wherein an induction heater for heating the pipe is rather closely association with groups of nozzles for quenching the pipe from the inside and from the outside.

Known equipment for quench-hardening operate for example by moving a pipe in vertical disposition of its axis through an induction heater and through a nozzle arrangement. Alternatively, the heated tube is dipped into a quenching bath. Pipes of 20 inch diameter and larger and at a length equal to or even in excess of 50 ft. are quite difficult to treat in that fashion, particularly because the vertical disposition requires rather complicated and large equipment.

Quench-hardening of pipes in horizontal disposition has not yet been successfully practiced for such large pipes. The equipment used here in attempts along that line uses rolls supporting the pipe at its inside apex and ahead of that part of the quenching equipment that sprays on the inside. Alternatively the inside quenching head is supported centrally in that portion of the pipe which has already been treated and quench hardened.

The problem of this approach which has not yet been solved is to be seen in the following. The cross-section of the pipe which has been heated to the hardening temperature is deformed by the force of gravity acting on the pipe, so that the contour encountered by the quenching nozzles is no longer a circular one. As the nozzle-to-pipe wall spacing is thus subject to local variation the intensity of quenching differs accordingly along the pipes periphery. Additionally, the centering of the quenching head operating on the inside becomes unreliable. Actually, the extent of deviation of the pipe from a circular cross-sectional contour is so great, and depends on so many different factors that a sufficiently uniform quench-hardening has not yet been practiced in that manner.

DESCRIPTION OF THE INVENTION

It is an object of the present invention to provide for quenching of a pipe that is uniform around the periphery thereof so that the pipe becomes uniformly hard accordingly.

It is a specific object of the present invention to maintain or to restore the cross-sectional contour of a pipe during quenching and to orient the quenching head inside of the pipe rather rigidly so that its weight will not deform the heated portion of the pipe, the orientation of that head is to be referenced to the exterior of the pipe.

In accordance with the preferred embodiment of the present invention it is suggested to hold the inside quench head in a quench-hardening station through guide rollers on the inside of the pipe passing through but without exerting the full load of that head on the pipe at all, while in the same range (radially) but on the outside the pipe is worked by calibration or sizing rolls to restore its circularity. These rolls engage the pipe almost over its entire periphery and some of the outside quenching nozzles are disposed right ahead of the sizing rolls while quenching is complete behind these rolls and on the sized pipe. The inside quenching head is mounted on a tube held in one of two thrust supports or mounts, one of them being placed behind the quenching station, the other one ahead of the heater which heats the pipe to hardening temperature. The two supports can open so that this tube is held on one of them or the other for passage of the pipe.

The combination of quench equipment and calibration and sizing rollers maintains or restores the circular profile of the pipe. The distance between induction heater and sizing rolls should be small so that any deformation that does occur is not significant as far as the hardening process is concerned as occurring right at and behind the quenching nozzles. The sizing of the pipe from the outside is carried out while the pipe is still quite hot so that forming and working power is not very high. On the other hand, some cooling on the outside has occurred so that the shape of the pipe as it leaves the sizing rolls is sufficiently fixed and the pipe does not need further support to maintain its shape, and the additional and final quenching occurring right behind the stand. The circularity of the pipe will be maintained thereafter.

It can readily be said, that quenching and sizing are carried out concurrently with the added provision that quenching starts slightly earlier, particularly as far as the outside is concerned, and is also extended beyond the sizing; there is, therefore, overlap particularly as far as the quenching beginning to take effect is concerned, and the pipe will leave the station with circular profile.

The quenching head is never supported by the rollers on the inside only. The two thrust mounts support the holding round bar or tube on both ends as long as a pipe is inbetween. One or the other, but never both mounts, are opened. As these thrust mounts provide for the basic support of the quenching head the latter can be guided even on the quite warm inside surface of the pipe so that quenching is equalized indeed.

The thrust mounts are spaced apart by little more than one pipe length. As stated, one of them is always closed so that the distance of the quenching head from the respective closed mount is only a little more than half a pipe length. The holding tube will sag very little. Better even is to place the two mounts at a distance of more than two pipe lengths apart as in that case the quenching head will be supported by the closed mounts at both ends during hardening.

The latter feature of spacing the mounts by two pipe lengths, particularly by spacing them by considerably more than two pipe lengths permits another mode of operation. If two pipes move in abutment end-face-of-one-to-front-face-of-the-other, through the quenching station, it is avoided that the outer quench nozzles spray into the pipes thus avoiding nonuniform quenching. The first of the two pipes is then moved out of the station faster while the other proceeds normally, and shortly thereafter another pipe is brought up from the rear. In these instances one needs to open the mounts, one at a time, only briefly, as the pipes are moved through at an accelerated rate.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Turning now to the detailed description of the drawings, FIG. 1 shows a roller track 1 on which pipes to be hardened will arrive from the right. A first stage heater 2 heats an arriving pipe to a temperature for which no deformation of the pipe under its own weight will yet occur. For regular steel pipes a preheating temperature of 650°C was found advisable.

Figure 1:
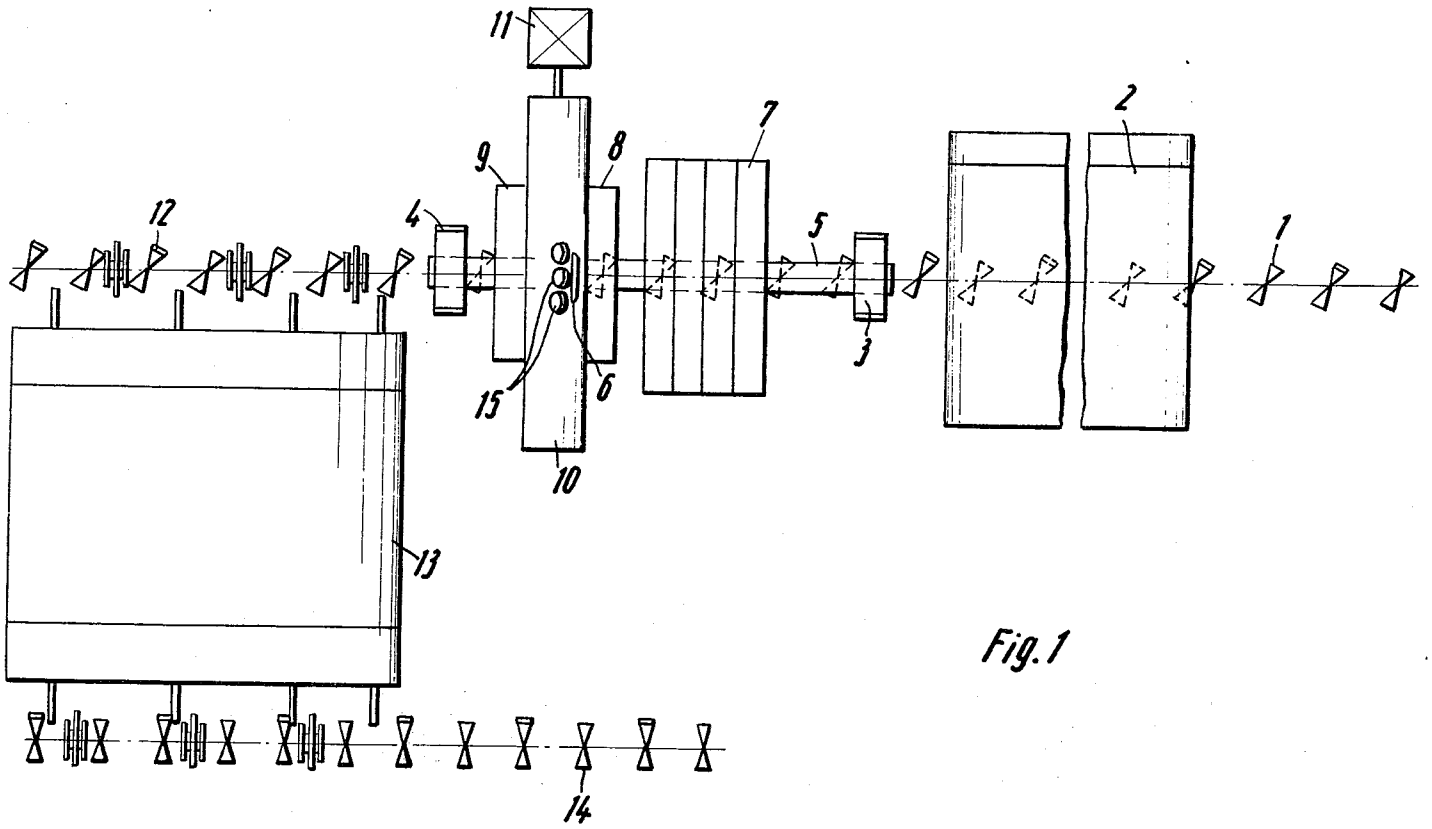
FIG. 1 is an overview of a pipe hardening plant with quenching equipment.

The preheated pipe leaves heater 2 and enters the quench-hardening station, which includes an induction heater 7 through which a pipe 16 passes for being progressively heated to hardening temperature. Down stream of heater 7 is positioned the outside quenching equipment which includes the groups 8 and 9 of nozzles. A calibrating and sizing roll mill stand 10 with drive 11 is provided between the nozzle groups 8 and 9, so that the outside of the pipe is prequenched just ahead of the rolls in stand 10 by nozzles 8, and quenching is completed by nozzles 9 right where the pipe leaves the mill stand 10.

Figure 2:
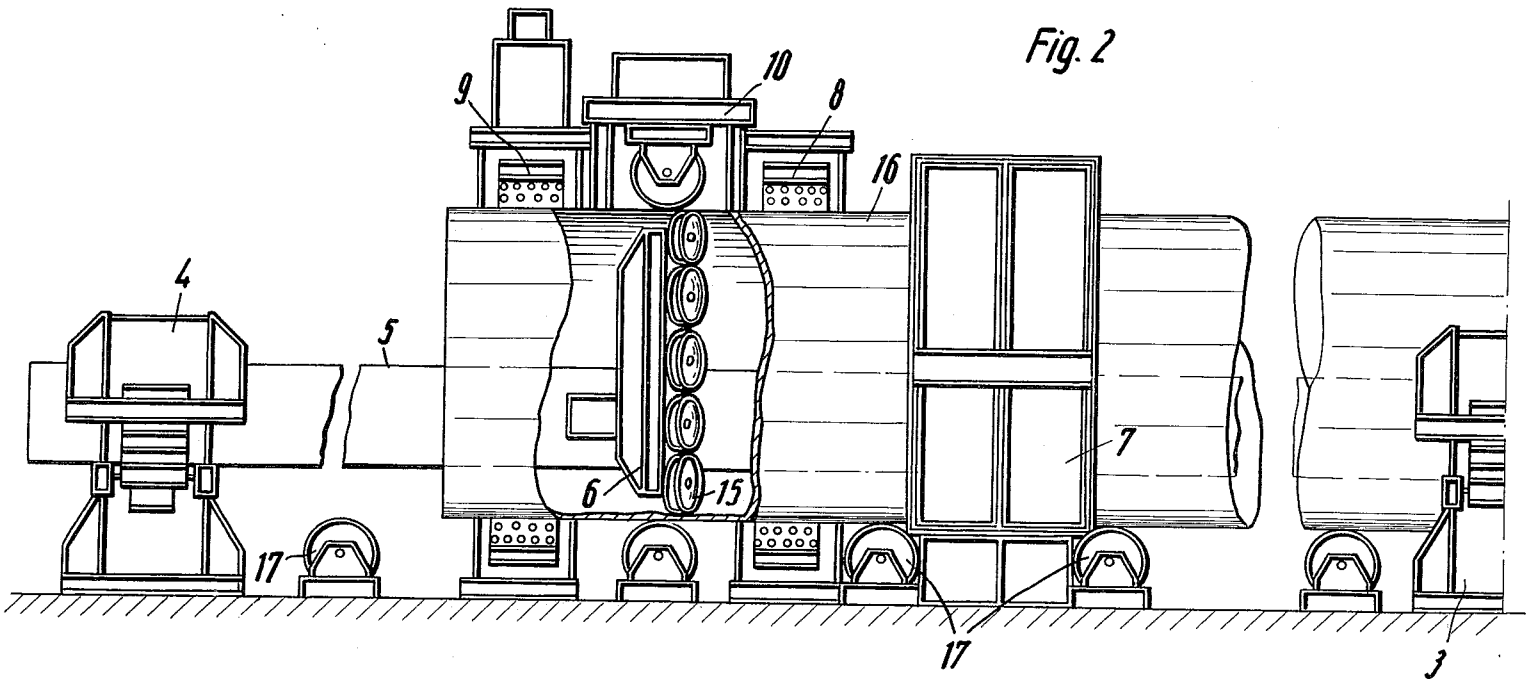
FIG. 2 is a cross-section through a portion of the plant, showing particularly the quenching operation.
Figure 3:
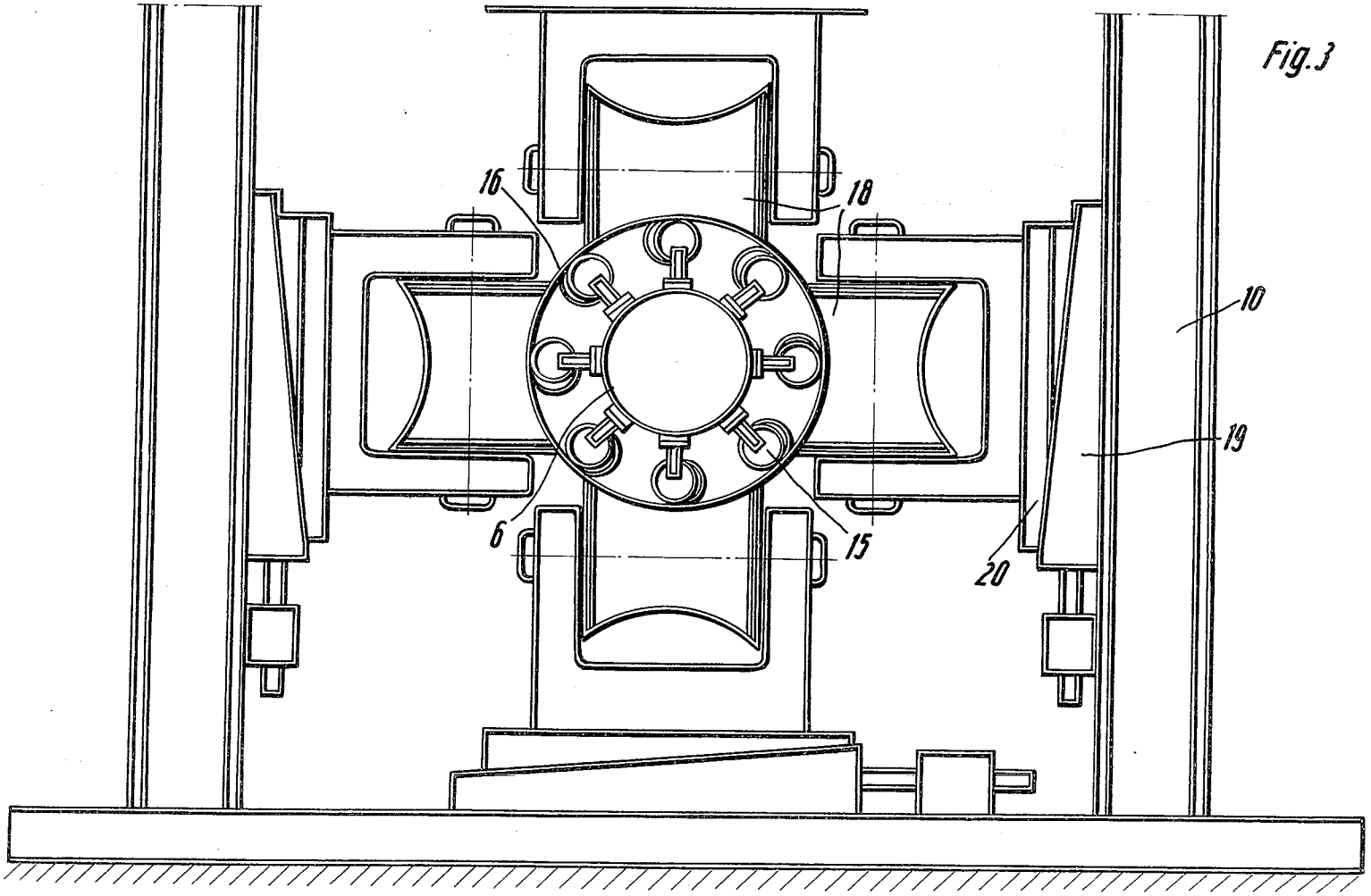
FIG. 3 is a cross-section through the sizing mill which is part of the inventive quenching station.

The internal quenching head 6 is situated on a support tube 5 which in turn is mounted in tilt-away mounts or bearings 3 and 4. Mount 3 tilts away when a pipe 16 enters the quench-hardening station so that the tube 5 with head 6 pass through the interior of the pipe. Mount 4 tilts away when the pipe 16 leaves the station. Of course at least one of the mounts 3, 4 is closed at all times to hold tube 5; only that one of the mounts tilts away along which a pipe 16 passes for entering or leaving the station. In FIG. 2, mount 4 holds support pipe 5 while mount 3 is tilted away to permit pipe 16 to pass.

A roller track 12 continues track 1 to move a pipe out of the quench-hardening station, and a lateral transport moves the pipe through a tempering furnace 13 and from there onto a roller track 14 on which the pipe is moved to the test and adjusting area for further processing.

The roller tracks 1 and 12 are constructed from oblique rollers so that the pipe 16 as it advances does not just move axially but turns also on its axis. This way, particularly, the pipe will pass through the induction heater and the quenching equipment while rotating on its own axis. A more uniform quench-hardening process is obtained in this manner. It was found, that the pipe should make one revolution for each advancing length of one diameter. A still smaller axial advance is not necessary.

After having described the general layout, the quench-hardening equipment and process will be considered in some detail. The preheated pipe 16 passes through tilt mount 3 which is open so that the pipe can pass. At this point, support tube 5 is held only by mount 4. After the pipe 16 has passed through mount 3 the latter is closed to hold pipe 5 while mount 4 is opened so that pipe 16 can leave.

Conceivably, mounts 3 and 4 may be spaced apart by two lengths of a pipe to be hardened, so that at first two pipes pass before closing mount 3 and opening mount 4. Subsequently opening and closing of the mounts is carried out after one pipe has entered and/or one pipe has left, so that always two pipes are disposed between the mounts. However, processing only one pipe may be advisable in this case. The quenching equipment should be placed right in the middle between the two mounts, so that the mount 3 is closed as soon as quenching begins. This way, head 6 on support tube 5 is supported by both mounts 3 and 4 during the entire quenching so that head 6 when bearing against the still warm inside of the pipe to be quenched is supported on both axial ends, and very little load (i.e., weight of the quenching head 6) acts on the pipe.

It should be noted further that the temperature of preheating (about 650°C) has been selected so that the contour of the pipe will not be deformed when travelling from preheater to the main heater. On the other hand, the power of the main heater can be lower accordingly and a more uniform heating is obtained when the induction heater operates on a preheated pipe in which any temperature differences have been equalized, to some extent at least, by thermal conduction in the pipe's wall.

A pipe passing through the station is progressively heated to hardening temperature while quenching is carried out subsequently on the outside through nozzle groups 8 and 9, and on the inside through quenching head 6.

The portion of the pipe as it extends between heater 7 and the quenching equipment will deform. That deformation is counteracted by rolls 18 in stand 10 operating in conjunction with guide rollers 15. These guide rollers are mounted to and journalled on the quenching head 16 while the calibrating rolls 18 envelope the pipe 16 almost completely about its periphery.

Due to the engagement with an axial moving pipe, mounts 3, 4 act as thrust mounts. The rollers 15 have inclined axes so that they roll on the axially and rotating pipe wall. No rotation is imparted upon the quenching head.

Significantly, the outside of the pipe as passing through the calibrating stand has already been cooled on the outside by the nozzle group 8 but just immediately ahead of the sizing in the mill so that the cross-section of the pipe can still be deformed at that point, particularly because the hardening of the steel has not yet occurred; the calibration and sizing can thus be carried out without excessive force nor is there any danger to the hardening texture which becomes rather un-deformible at that point, but the deformation of calibration is not that large. The calibrating and sizing rolls will be cooled extensively so that they do not interfere with the quenching process. Nozzles 9 complete the quenching on the outside.

FIG. 2 shows a pipe 16 as its front end is just leaving the second group of quenching nozzles 9. The front or entrance mount 3 is open, the rear mount 4 is still closed. Soon, the latter will be opened and the former will close. Rolls 17 pertain to the roller track for moving the pipe through the station and supporting pipe 16 in many points along its travel path. As stated, the pipe turns on its own axis particularly while passing through the sizing mill as well as while passing along the quenching nozzles on the inside as well as on the outside. The pipe hardens quite uniformly while its circularity in cross-section is maintained.

One or several rolls 17 ahead of calibrating and sizing stand 10 may cooperate with additional outside rolls in different levels for forcing the pipe 6 into and through the rolls in stand 10 and inbetween the contoured rolls 15 therein. Rolls 17 may be adjustibly positioned here to adjust the station to the particular pipe diameter.

Rolls 18 may have axes which are inclined to the vertical relative to the pipes axis. Adjustible journal holders 19, 20 permit centering of rolls 18 with respect to the axis of pipe 16. The well supported quenching head 6 with inside guide rollers 15 cooperate with the rolls 18 of the sizing mill for centering.

The invention is not limited to the embodiments described above but all changes and modifications thereof not constituting departures from the spirit and scope of the invention are intended to be included.

One of such modifications involves the following mode of operation. If the two mounts are spaced apart by considerably more than two pipe lengths, one can move these two pipes in a position through the quenching station wherein the front end of the trailing pipe abuts the rear end of the leading pipe. This way, they cover each other and quenching water from the outer nozzles 8, 9 will not enter the inside of the pipes. Once these abutting ends of the pipes have passed through, mount 4 is opened briefly and the leading pipe is moved fast therethrough, by and onto roller track 12. Mount 4 then closes again, and mount 3 opens, and another pipe is rapidly moved in until abutting the pipe which is continued to be quenched and still moves at a lower rate. Mount 3 closes and both pipes move slowly until their abutting ends have passed through the quenching stations. One has to drive certain rolls in the quenching station faster in these cases, but only temporarily so. This involves particularly, the rolls between the mounts and those ahead of mount 3. Track 12 may have fast moving rolls.

We claim:

1. In a station for quench-hardening of pipes of large diameter and having an induction heater, quenching means acting on the pipe from the outside and a quenching head acting on the pipe from the inside, the improvement comprising:

roller means for engaging and bearing against the pipe on the inside thereby positioning the quenching head centrally in the pipe right in a zone of quenching of the pipe from the inside;

thrust mount means for supporting the quenching head outside from the pipe but for central positioning therein;

a sizing roller stand with calibrating/sizing rolls engaging the pipe over almost its entire periphery adjacent the inside quenching head and particularly adjacent to said roller means;

a plurality of nozzles included in said outside quenching means and disposed right at but ahead of the stand, for prequenching the pipe from the outside and immediately ahead of the sizing in the stand; and an additional plurality of nozzles also included in said outside quenching means and disposed behind said stand for continuing quenching the pipe from the outside as it leaves the stand.

2. In a station as in claim 1 having means for passing pipes through the station in continuous sequence without reversal and including a support tube for holding the quenching head, and the first and second thrust mounts or bearings for holding the support tube, the mounts being individually operable for permitting passing of the pipe, said tube being always held by at least one offset mounts.

3. In a station as in claim 2, wherein the mounts are spaced apart by a little more than the length of a pipe.

4. In a station as in claim 2, wherein the mounts are spaced apart by a little more than two lengths of a pipe.

5. In a station as in claim 1 and including a preheater for heating a steel pipe to a temperature of about 650°C prior to being heated in said induction heater.

6. In a station as in claim 2, wherein the mounts are spaced by considerably more than two pipe lengths, the pipes moving through the station so that two pipes abut and their respective abutting ends pass along said nozzles together, so that the pipes cover each other's ends.

7. In a station as in claim 1, wherein the pipes rotate on their axis as they advance with about one revolution per advance by a distance of about one axial diameter.

* * * * *